US008315857B2

(12) United States Patent
Klein et al.

(10) Patent No.: US 8,315,857 B2
(45) Date of Patent: Nov. 20, 2012

(54) SYSTEMS AND METHODS FOR AUDIO SIGNAL ANALYSIS AND MODIFICATION

(75) Inventors: David Klein, Mountain View, CA (US); Stephen Malinowski, Mountain View, CA (US); Lloyd Watts, Mountain View, CA (US); Bernard Mont-Reynaud, Mountain View, CA (US)

(73) Assignee: Audience, Inc., Mountain View, CA (US)

( * ) Notice: Subject to any disclaimer, the term of this patent is extended or adjusted under 35 U.S.C. 154(b) by 666 days.

(21) Appl. No.: 11/444,060

(22) Filed: May 30, 2006

(65) Prior Publication Data

US 2007/0010999 A1 Jan. 11, 2007

Related U.S. Application Data

(60) Provisional application No. 60/685,750, filed on May 27, 2005.

(51) Int. Cl.
*G10L 19/14* (2006.01)

(52) U.S. Cl. ..... 704/211; 704/251; 704/252; 704/254; 704/256; 704/256.1

(58) Field of Classification Search ..... None
See application file for complete search history.

(56) References Cited

U.S. PATENT DOCUMENTS

| | | | | |
|---|---|---|---|---|
| 5,229,716 | A * | 7/1993 | Demoment et al. | 324/307 |
| 6,151,575 | A * | 11/2000 | Newman et al. | 704/260 |
| 6,460,017 | B1 * | 10/2002 | Bub et al. | 704/256 |
| 6,510,408 | B1 | 1/2003 | Hermansen | |
| 2002/0062212 | A1 * | 5/2002 | Nakatsuka | 704/240 |
| 2003/0050783 | A1 * | 3/2003 | Yoshizawa | 704/270.1 |
| 2004/0042626 | A1 * | 3/2004 | Balan et al. | 381/110 |
| 2004/0059576 | A1 * | 3/2004 | Lucke | 704/256 |
| 2004/0230420 | A1 * | 11/2004 | Kadambe et al. | 704/205 |
| 2006/0240786 | A1 * | 10/2006 | Liu | 455/114.3 |

FOREIGN PATENT DOCUMENTS

| | | |
|---|---|---|
| EP | 1450353 A1 | 8/2004 |
| JP | 2002073072 | 8/2000 |
| JP | 2001125562 | 5/2001 |
| JP | 2003099085 | 4/2003 |
| JP | 2003177790 | 6/2003 |
| JP | 2004287010 | 10/2004 |

* cited by examiner

*Primary Examiner* — Leonard Saint Cyr
(74) *Attorney, Agent, or Firm* — Carr & Ferrell LLP

(57) ABSTRACT

Systems and methods for modification of an audio input signal are provided. In exemplary embodiments, an adaptive multiple-model optimizer is configured to generate at least one source model parameter for facilitating modification of an analyzed signal. The adaptive multiple-model optimizer comprises a segment grouping engine and a source grouping engine. The segment grouping engine is configured to group simultaneous feature segments to generate at least one segment model. The at least one segment model is used by the source grouping engine to generate at least one source model, which comprises the at least one source model parameter. Control signals for modification of the analyzed signal may then be generated based on the at least one source model parameter.

19 Claims, 6 Drawing Sheets

SYSTEMS AND METHODS FOR AUDIO SIGNAL ANALYSIS AND MODIFICATION

CROSS-REFERENCE TO RELATED APPLICATIONS

The present application claims the priority benefit of U.S. Provisional Application No. 60/685,750 entitled "Sound Analysis and Modification Using Hierarchical Adaptive Multiple-Module Optimizer" filed May 27, 2005 which is herein incorporated by reference.

BACKGROUND OF THE INVENTION

1. Field of the Invention

Embodiments of the present invention are related to audio processing, and more particularly to analysis and modification of audio signals.

2. Related Art

Typically, a microphone or set of microphones detect a mixture of sounds. For proper playback, transmission, editing, analysis, or speech recognition, it is desirable to isolate the constituent sounds from each other. By separating audio signals based on their audio sources, noise may be reduced, voices in multiple-talker environments can be isolated, and word accuracy can be improved in speech recognition, as examples.

Disadvantageously, existing techniques for isolating sounds are inadequate in dealing with complex situations, such as the presence of multiple audio sources generating an audio signal or the presence of noise or interference. This may lead to high word error rates or limits on degree of speech enhancement that can be obtained with current art.

Therefore, there is a need for systems and methods for audio analysis and modification. There is a further need for the systems and methods to handle audio signals comprising a plurality of audio sources.

SUMMARY OF THE INVENTION

Embodiments of the present invention provide systems and methods for modification of an audio input signal. In exemplary embodiments, an adaptive multiple-model optimizer is configured to generate at least one source model parameter for facilitating modification of an analyzed signal. The adaptive multiple-model optimizer comprises a segment grouping engine and a source grouping engine.

The segment grouping engine is configured to group simultaneous feature segments to generate at least one segment model. In one embodiment, the segment grouping engine receives feature segments from a feature extractor. These feature segments may represent tone, transient, and noise feature segments. The feature segments are grouped based on their respective features in order to generate the at least one segment model for that feature.

The at least one segment model is then used by the source grouping engine to generate at least one source model. The at least one source model comprises the at least one source model parameter. Control signals for modification of the analyzed signal may then be generated based on the at least one source model parameter.

DETAILED DESCRIPTION OF EXEMPLARY EMBODIMENTS

Embodiments of the present invention provide systems and methods for audio signal analysis and modification. In exemplary embodiments, an audio signal is analyzed and separate sounds from distinct audio sources are grouped together to enhance desired sounds and/or suppress or eliminate noise. In some examples, this auditory analysis can be used as a front end for speech recognition to improve word accuracy, for speech enhancement to improve subjective quality, or music transcription.

Figure 1:
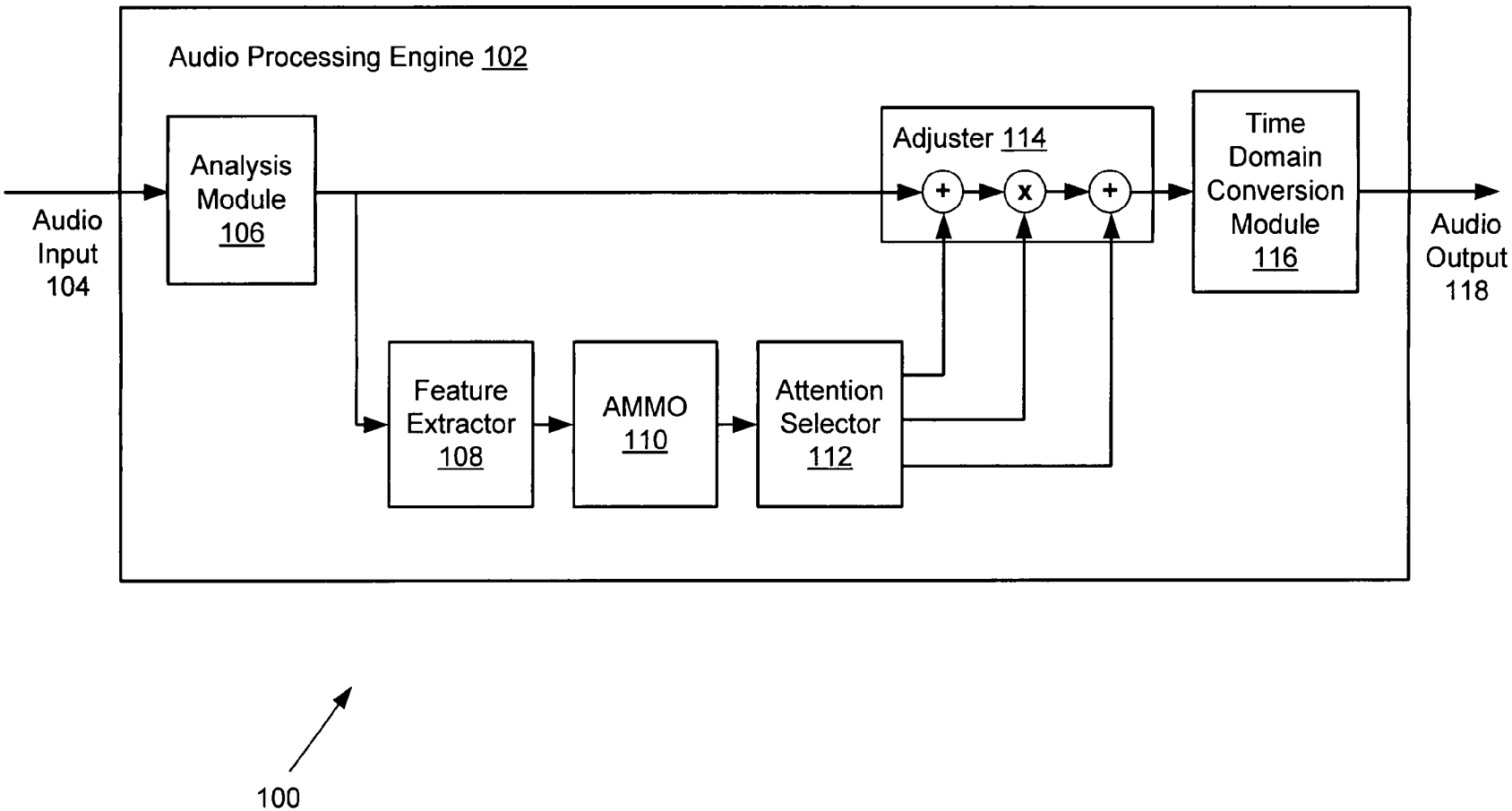
FIG. 1 is an exemplary block diagram of an audio processing engine employing embodiments of the present invention.

Referring to FIG. 1, an exemplary system 100 in which embodiments of the present invention may be practiced is shown. The system 100 may be any device, such as, but not limited to, a cellular phone, hearing aid, speakerphone, telephone, computer, or any other device capable of processing audio signals. The system 100 may also represent an audio path of any of these devices.

The system 100 comprises an audio processing engine 102 which receives and processes an audio input signal over audio input 104. The audio input signal may be received from one or more audio input devices (not shown). In one embodiment, the audio input device may be one or more microphones coupled to an analog-to-digital (A/D) converter. The microphone is configured to receive analog audio input signals while the A/D converter samples the analog audio input signals to convert the analog audio input signals into digital audio input signals suitable for further processing. In alternative embodiments, the audio input device is configured to receive digital audio input signals. For example, the audio input device may be a disk device capable of reading audio input signal data stored on a hard disk or other forms of media. Further embodiments may utilize other forms of audio input signal sensing/capturing devices.

The exemplary audio processing engine 102 comprises an analysis module 106, a feature extractor 108, an adaptive multiple-model optimizer (AMMO) 110, an attention selector 112, an adjuster 114, and a time domain conversion module 116. Further components not related to analysis and modification of the audio input signal, according to embodiments of the present invention, may be provided in the audio processing engine 102. Additionally, while the audio processing engine 102 describes a logical progression of data from each component of the audio processing engine 102 to the next component, alternative embodiments may comprise the various components of the audio processing engine 102 coupled via one or more buses or other components. In one embodiment, the audio processing engine 102 comprises software stored on a device which is operated upon by a general processor.

The analysis module 106 decomposes the received audio input signal into a plurality of sub-band signals in the frequency domain (i.e., time frequency data or spectral-temporal analyzed data). In exemplary embodiments, each sub-band or analyzed signal represents a frequency component. In some embodiments, the analysis module 106 is a filter bank or cochlear model. The filter bank may comprise any number of filters and the filters may be of any order (e.g., first order, second order, etc.). Furthermore, the filters may be positioned in a cascade formation. Alternatively, the analysis may be performed using other analysis methods including, but not limited to, short-term Fourier transform, fast Fourier transform, wavelets, Gammatone filter banks, Gabor filters, and modulated complex lapped transforms.

The exemplary feature extractor 108 extracts or separates the analyzed signal according to features to produce feature segments. These features may comprise tones, transients, and noise (patch) characteristics. The tone of a portion of the analyzed signal refers to a particular and usually steady pitch. A transient is a non-periodic, or non-repeating, portion of the analyzed signal. Noise or flux is incoherent signal energy that is neither tone-like nor transient-like. In some embodiments, noise or flux also refers to distortion which is an unwanted portion associated with a desired portion of the analyzed signal. For example, an "s" sound in speech is noise-like (i.e., not tonal or transient), but it is part of a voice that is desired. As a further example, some tones (e.g., a cell phone ringtone in background) are not noise-like; however, it is still desirable to remove this flux.

The separated feature segments are passed to the AMMO 110. These feature segments comprise parameters that allow models to be fit to best describe the time frequency data. The feature extractor 108 will be discussed in more detail in connection with FIG. 2 below.

The AMMO 110 is configured to generate instances of source models. A source model is a model associated with an audio source producing at least a portion of the audio input signal. In exemplary embodiments, the AMMO 110 comprises a hierarchical adaptive multiple-model optimizer. The AMMO 110 will be discussed in more detail in connection with FIG. 3.

Once the source models having the best fit are determined by the AMMO 110, the source models are provided to the attention selector 112. The attention selector 112 selects primary audio stream(s). These primary audio streams are parts of a time-varying spectrum that correspond to a desired audio source.

The attention selector 112 controls the adjuster 114 which modifies the analyzed signal to enhance the primary audio streams. In exemplary embodiments, the attention selector 112 sends control signals to the adjuster 114 to modify the analyzed signals from the analysis module 106. The modification includes cancellation, suppression, and filling-in of the analyzed signals.

The time domain conversion module 116 may comprise any component which converts the modified audio signals from a frequency domain into time domain for output as an audio output signal 118. In one embodiment, the time domain conversion module 116 comprises a reconstruction module which reconstructs the processed signals into a reconstructed audio signal. The reconstructed audio signal may then be transmitted, stored, edited, transcribed, or listened to by an individual. In another embodiment, the time domain conversion module 116 may comprise a speech recognition module which automatically recognizes speech and can analyze phonetics and determine words. Any number and types of time domain conversion modules 116 may be embodied within the audio processing engine 102.

Figure 2:
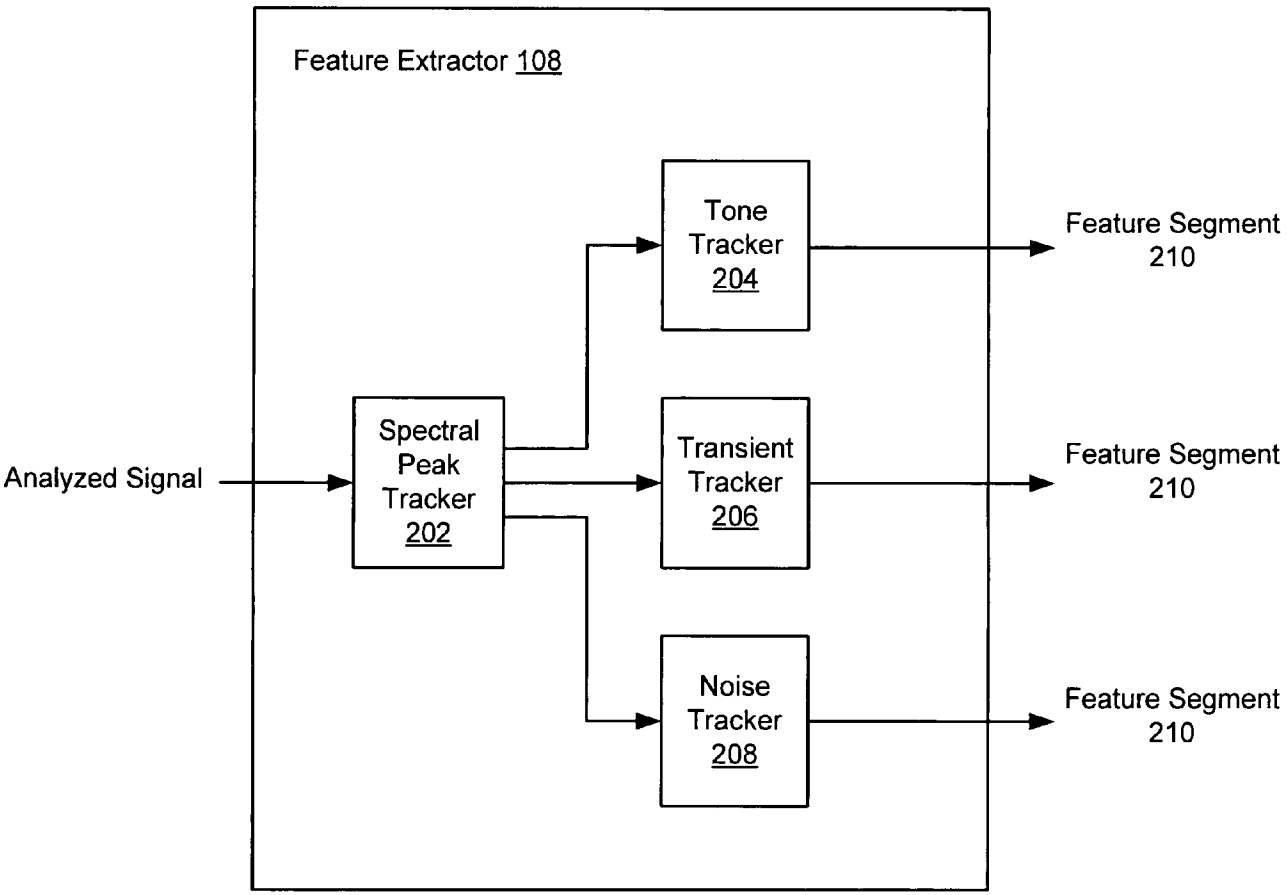
FIG. 2 is an exemplary block diagram of the feature extractor.

Referring now to FIG. 2, the feature extractor 108 is shown in more detail. The feature extractor 108 separates energy in the analyzed signal into subunits of certain spectral shapes (e.g., tone, transients, and noise). These subunits are also referred to as feature segments.

In exemplary embodiments, the feature extractor 108 takes the analyzed signal, which is in the time frequency domain, and assigns different portions of the analyzed signal to different segments by fitting different portions of the analyzed signal to spectral shape models or trackers. In one embodiment, a spectral peak tracker 202 locates spectral peaks (energy peaks) of the time frequency data (i.e., analyzed signal). In an alternative embodiment, the spectral tracker 202 determines crests and crest peaks of the time frequency data. The peak data are then input into the spectral shape trackers.

In another embodiment, an analysis filter bank module as described in U.S. patent application Ser. No. 11/441,675, filed May 25, 2006 and entitled "System and Method for Processing an Audio Signal," and herein incorporated by reference, may be used to determine energy peaks or spectral peaks of the time frequency data. This exemplary analysis filter bank module comprises a filter cascade of complex-valued filters. In a further embodiment, this analysis filter bank module may be incorporated into, or comprise, the analysis module 106. In further alternative embodiments, other modules and systems may be utilized to determine energy or spectral peak data.

According to one embodiment, the spectral shape trackers comprise a tone tracker 204, a transient tracker 206, and a noise tracker 208. Alternative embodiments may comprise other spectral shape trackers in various combinations. The output of the spectral shape trackers are feature segments 210 that allow models to be fit to best describe the time frequency data.

The tone tracker 204 follows spectral peaks that have some continuity in terms of their amplitude and frequency in the time frequency or spectro-temporal domain that fit a tone. A tone may be identified, for example, by a constant amplitude with a constant or smoothly changing frequency signal. In exemplary embodiments, the tone tracker 204 produces a plurality of signal outputs, such as amplitude, amplitude slope, amplitude peaks, frequency, frequency slope, beginning and ending time of tone, and tone salience.

The transient tracker 206 follows spectral peaks that have some continuity in terms of their amplitude and frequency that are transient. A transient signal may be identified, for example, by a constant amplitude with all frequencies excited for a short time period. In exemplary embodiments, the transient tracker 206 produces a plurality of output signals including, but not limited to, amplitude, amplitude peaks, frequency, beginning and ending time of transient, and total transient energy.

The noise tracker 208 follows model broadband signals that appear over time. Noise may be identified by a constant amplitude with all frequencies excited over long periods of time. In exemplary embodiments, the noise tracker 208 produces a plurality of output signals, such as amplitude as a function of spectro-temporal position, temporal extent, frequency extent, and total noise energy.

Figure 3:
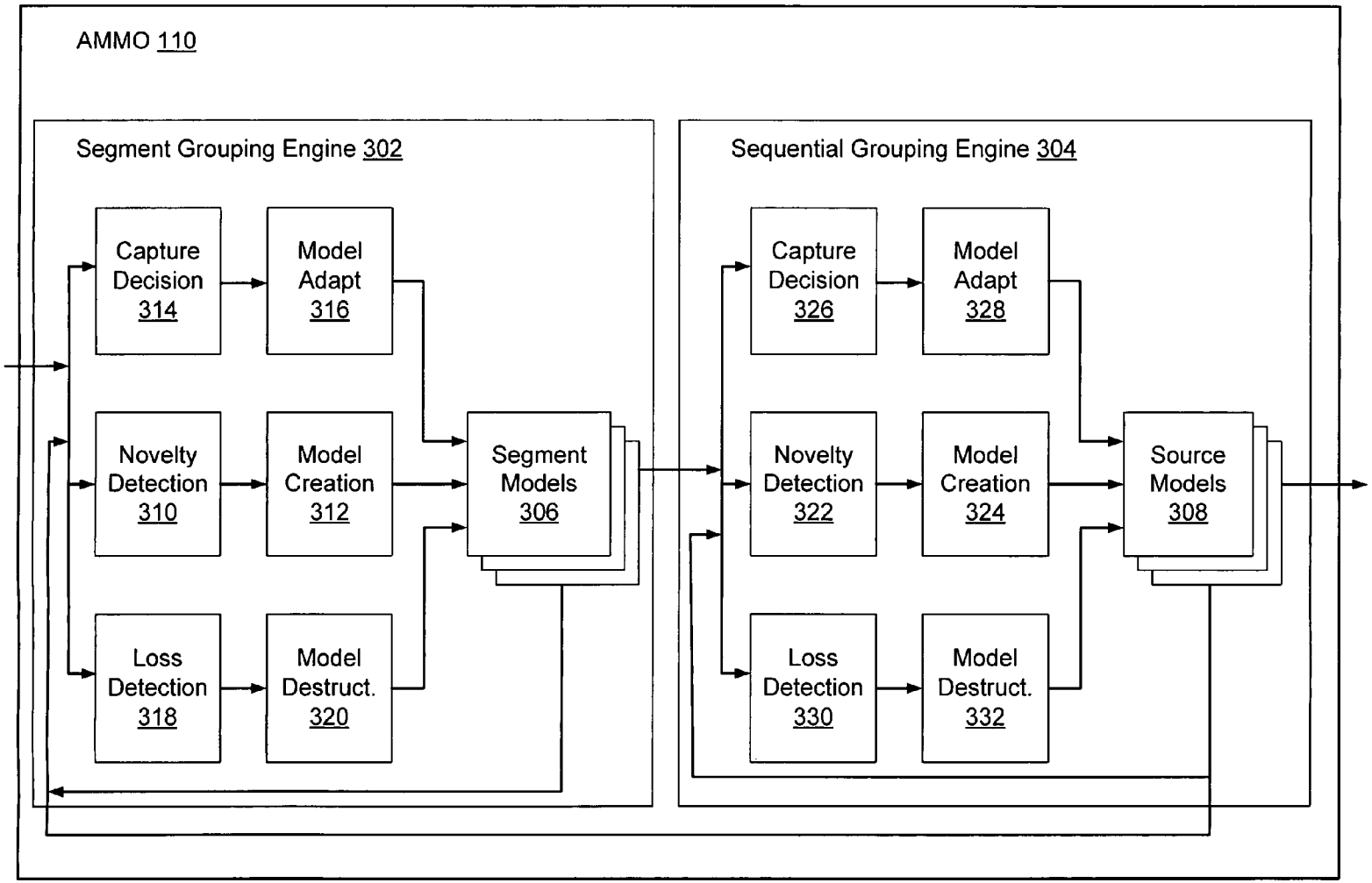
FIG. 3 is an exemplary block diagram of the adaptive multiple-module optimizer.

Once the sound energy has been separated into various feature segments 210 (e.g., tone, transient, and noise), the AMMO 110 groups the sound energy into its component streams and generates source models. Referring now to FIG. 3, the exemplary AMMO 110 is shown in more detail having a two-layer hierarchy. The AMMO 110 comprises a segment grouping engine 302 and a sequential grouping engine 304. The first layer is performed by the segment grouping engine 302, while the second layer is performed by the sequential grouping engine 304.

The segment grouping engine 302 comprises a novelty detection module 310, a model creation module 312, a capture decision module 314, a model adaptation module 316, a loss detection module 318, and a model destruction module 320. The model adaptation module 316, the model creation module 312, and the model destruction module 320 are each coupled to one or more segment models 306. The sequential grouping engine 304 comprises a novelty detection module 322, a model creation module 324, a capture decision module 326, a model adaptation module 328, a loss detection module 330, and a model destruction module 332. The model adaptation module 328, the model creation module 324, and the model destruction module 332 are each coupled to one or more segment models 306.

The segment grouping engine 302 groups simultaneous features into temporally local segments. The grouping process includes creating, tracking, and destroying hypotheses (i.e., putative models) about various feature segments that have evidence in the incoming feature set. These feature segments change and may appear and disappear over time. In one embodiment, the model tracking is performed using Kalman-like cost minimization strategy in a context of multiple models competing to explain a given data set.

In exemplary embodiments, the segment grouping engine 302 performs simultaneous grouping of feature segments to create auditory segments as instances of segment models 306. These auditory segments comprise groupings of like feature segments. In one example, auditory segments comprise a simultaneous grouping of feature segments associated by a specific tone. In another example, the auditory segments comprise a simultaneous grouping of feature segments associated by a transient.

In exemplary embodiments, the segment grouping engine 302 receives the feature segment. If the novelty detection module 310 determines that the feature segment has not been previously received or does not fit a segment model 306, the novelty detection module 310 can direct the model creation module 312 to create a new segment model 306. In some embodiments, the new segment model 306 may be compared to the feature segment or a new feature segment to determine if the new segment model 306 needs to be adapted to fine tune the model (e.g., within the capture decision module 314) or destroyed (e.g., within the loss detection module 318).

If the capture decision module 314 determines that the feature segment imperfectly fits an existing segment model 306, the capture decision module 314 directs the model adaptation module 316 to adapt an existing segment model 306. In some embodiments, the adapted segment model 306 is compared to the feature segment or a new feature segment to determine if the adapted segment model 306 needs further adaptation. Once the best fit of the adapted segment model 306 is found, the parameters of the adapted segment model 306 may be transmitted to the sequential grouping engine 304.

If the loss detection module 318 determines that a segment model 306 insufficiently fits the feature segment, the loss detection module 318 directs the model destruction module 320 to destroy the segment model 306. In one example, the feature segment is compared to a segment model 306. If the residual is high, the loss detection module 318 may determine to destroy the segment model 306. The residual is observed signal energy not accounted for by the segment model 306. Subsequently, the novelty detection module 310 may direct the model creation module 312 to create a new segment model 306 to better fit the feature segment.

The instances of segment models 306 are then provided to the sequential grouping engine 304. In some embodiments, the instances of segment models 306 comprise parameters of the segment models 306 or auditory segments. The auditory objects are assembled sequentially from the feature segments. The sequential grouping engine 304 creates, tracks, and destroys hypotheses about sequential or source groups of most likely feature segments in order to create source models 308. In one embodiment, the output of the sequential grouping engine 304 (i.e., instances of source models 308) may feed back to the segment grouping engine 302.

An audio source represents a real entity or process that produces sound. For example, the audio source may be a participant in a conference call or an instrument in an orchestra. These audio sources are represented by a plurality of instances of source models 308. In embodiments of the present invention, the instances of source models 308 are created by sequentially assembling the feature segments (segment models 306) from the segment grouping engine 302. For example, successive phonemes (feature segments) from one speaker may be grouped to create a voice (audio source) that is separate from other audio sources.

In one example, the sequential grouping engine 304 receives parameters of segment models 306. If the novelty detection module 322 determines that the parameters of segment models 306 have not been previously received or do not fit a source model 308, the novelty detection module 322 can direct the model creation module 324 to create new source model 308. In some embodiments, the new source model 308 may be compared to the parameters of segment models 306 or a new parameters of segment models 306 to determine if the new source model 308 needs to be adapted to fine tune the model (e.g., within the capture decision module 326) or destroyed (e.g., within the loss detection module 330).

If the capture decision module 326 determines that the parameters of segment models 306 imperfectly fits an existing source model 308, the capture decision module 326 directs the model adaptation module 328 to adapt an existing source model 308. In some embodiments, the adapted source model 308 is compared to the parameters of segment models 306 or new parameters of segment models 306 to determine if the adapted source model 308 needs further adaptation. Once the best fit of the adapted source model 308 is found, the parameters of the adapted source model 308 may be transmitted to the attention selector 112 (FIG. 1).

In an example, a source model 308 is used to generate a predicted parameter of a segment model 306. The variance between the predicted parameter of the segment model 306 and the received parameter of the segment model 306 is measured. The source model 308 may then be configured (adapted) based on the variance to form a better source model 308 that can subsequently produce a more accurate predicted parameter with lower comparative variance.

If the loss detection module 330 determines that a source model 308 insufficiently fits the parameters of segment models 306, the loss detection module 330 directs the model destruction module 332 to destroy the source model 308. In one example, the parameters of segment models 306 are compared to a source model 308. The residual is observed signal energy not accounted for by the source model 308. If the residual is high, the loss detection module 330 may determine to destroy the source model 308. Subsequently, the novelty detection module 322 may direct the model creation module 324 to create a new source model 308 to better fit the parameters of segment models 306.

In an example, a source model 308 is used to generate a predicted parameter of a segment model 306. The variance between the predicted parameter of the segment model 306 and the received parameter of the segment model 306 is measured. In some embodiments, the variance is the residual. The source model 308 may then be destroyed based on the variance.

In exemplary embodiments, parameter fitting for the segment models 306 can be achieved using probabilistic methods. In one embodiment, the probabilistic method is a Bayesian method. In one embodiment, the AMMO 110 converts tone observations (effects) into periodic segment parameters (causes) by computing and maximizing posterior probabilities. This can happen in real-time without significant latencies. The AMMO 110 may rely upon estimating model parameters in terms of means and variances using Maximum A Posteriori (MAP) criteria applied to the joint posterior probability of a set of segment models.

The probability of a model $M_i$ given an observation $O_i$ is given by Bayes theorem as:

$$P(M_i|O_i)=P(O_i|M_i)*P(M_i)/P(O_i)$$

wherein for a number N total models, a sum over i is performed, where i=1 to N.

The objective is to maximize the probabilities of the models. This maximization of probabilities may also be obtained by minimizing cost, where cost is defined as—log(P), and P is any probability. Thus, maximization of $P(M_i|O_i)$ may be achieved by minimizing the cost $c(M_i|O_i)$, where $$c(M_i|O_i)=c(O_i|M_i)+c(M_i)-c(O_i)$$

The posterior cost is the sum of the observation cost and prior cost. Because $c(O_i)$ does not participate in the minimization process, $c(O_i)$ may be ignored. $c(O_i|M_i)$ is referred to as an observation cost (e.g., difference between the model and observed spectral peaks) and $c(M_i)$ is referred to as a prior cost which is associated with the model, itself. The observation cost, $c(O_i|M_i)$, is calculated using differences between a given model and an observed signal of the peaks in the spectro-temporal domain. In one example, a classifier estimates the parameters of a single model. The classifier may be used to fit the parameters of a set of model instances (e.g., a model instance fits a subset of observation). To do this, an allocation of observations among models can be formed through accounting constraints (e.g., minimizing cost).

For example, a model for a given set of parameters will predict a peak in the spectro-temporal domain. The peak can be compared to the observed peak. Differences in the observed and the predicted peak can be measured in one or more variables. Corrections in the model may be made based on the one or more variables. The variables which may be used in the cost calculation for a tone model comprise amplitude, amplitude slope, amplitude peaks, frequency, frequency slope, beginning and ending times, and salience from integrated tone energy. For a transient model, the variables that can be used for cost calculation comprise amplitude, amplitude peaks, beginning and ending time of the transient, and total transient energy. Noise models may utilize variables such as amplitude as a function of spectro-temporal position, temporal extent, frequency extent, and total noise energy for cost calculations.

In an embodiment comprising a plurality of input devices (e.g., a plurality of microphones), inter-microphone similarities and differences may be computed. These similarities and differences may then be used in the cost calculations described above. In one embodiment, inter-aural time differences (ITDs) and inter-aural level differences (ILDs) may be computed using techniques described in U.S. Pat. No. 6,792,118 and entitled "Computation of Multi-Sensor Time Delays," which is herein incorporated by reference. Alternatively, a cross-correlation function in the spectral domain may be utilized.

Figure 4:
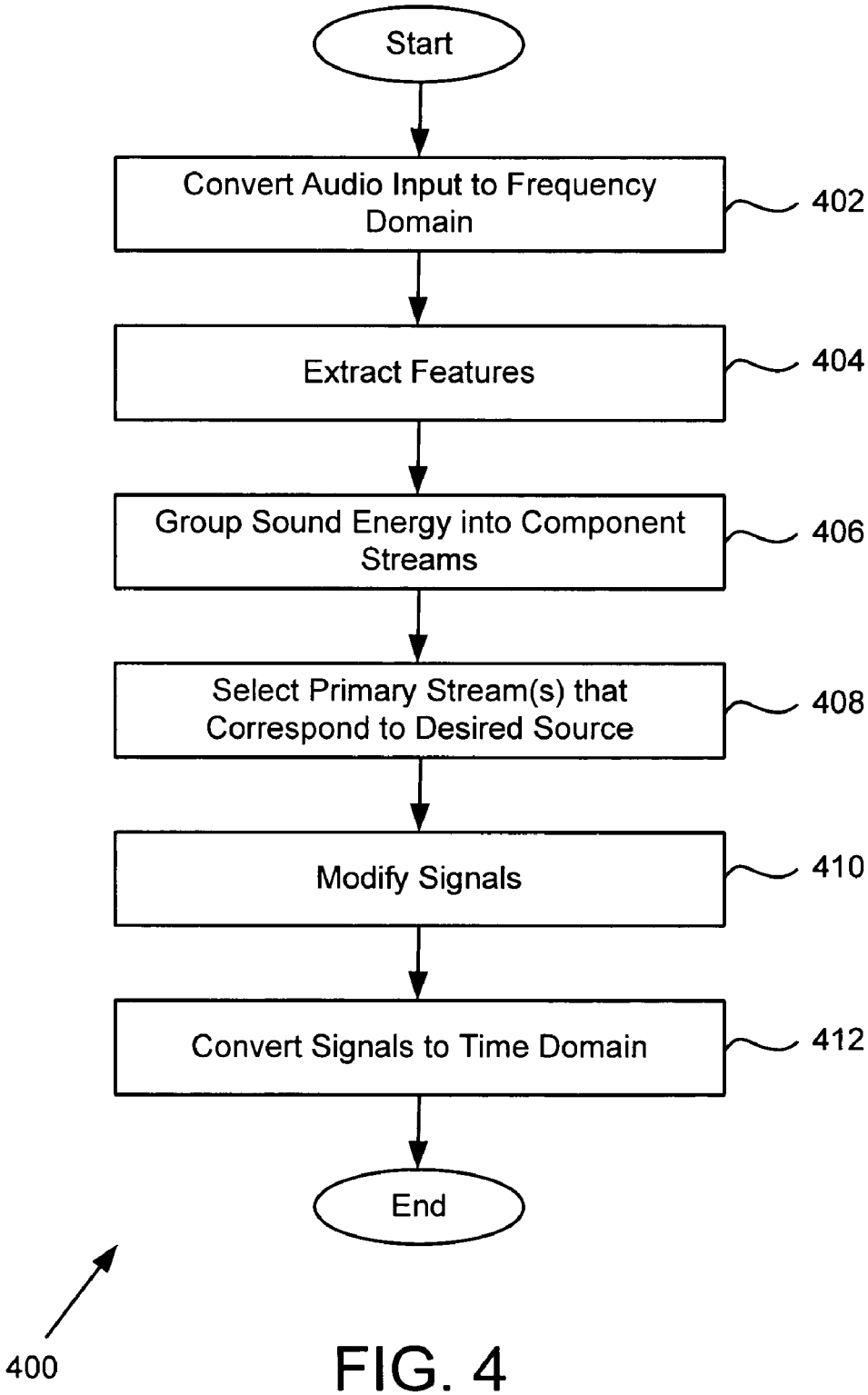
FIG. 4 is a flowchart of an exemplary method for audio analysis and modification.

Referring now to FIG. 4, a flowchart 400 of an exemplary method for audio analysis and modification is shown. In step 402, the audio input 104 (FIG. 1) is converted to the frequency domain for analysis. The conversion is performed by an analysis module 106 (FIG. 1). In one embodiment, the analysis module 106 comprises a filter bank or cochlear model. Alternatively, the conversion may be performed using other analysis methods such as short-term Fourier transform, fast Fourier transform, wavelets, Gammatone filter banks, Gabor filters, and modulated complex lapped transforms.

Features are then extracted by a feature extractor in step 404. The features may comprise tones, transients, and noise. Alternative features may be determined instead of, or in addition to, these features. In exemplary embodiments, the features are determined by analyzing spectral peaks of the analyzed signals. The various features can then be tracked by trackers (e.g., tone, transient, or noise trackers) and extracted.

Once extracted, the feature may be grouped into component streams in step 406. According to one embodiment, the features are provided to an AMMO 110 (FIG. 1) for fitting models that best describe the time frequency data. The AMMO 110 may be a two-layer hierarchy. For example, a first layer may group simultaneous features into temporally local segment models. A second layer then groups sequential temporally local segment models together to form one or more source models. The source models comprise component streams of grouped sound energy.

In step 408, (primary) component streams that correspond to a desired audio source are selected. In one embodiment, the attention selector 112 sends control signals to the adjuster 114 to select and modify (step 410) the analyzed signal (in the time-varying spectrum) from the analysis module 106.

Once modified, the signal (i.e., modified spectrum) is converted to time domain in step 412. In one embodiment, the conversion is performed by a reconstruction module that reconstructs the modified signals into a reconstructed audio signal. In an alternative embodiment, the conversion is performed by a speech recognition module which analyzes phonetics and determines words. Other forms of time domain conversion may be utilized in alternative embodiments.

Figure 5:
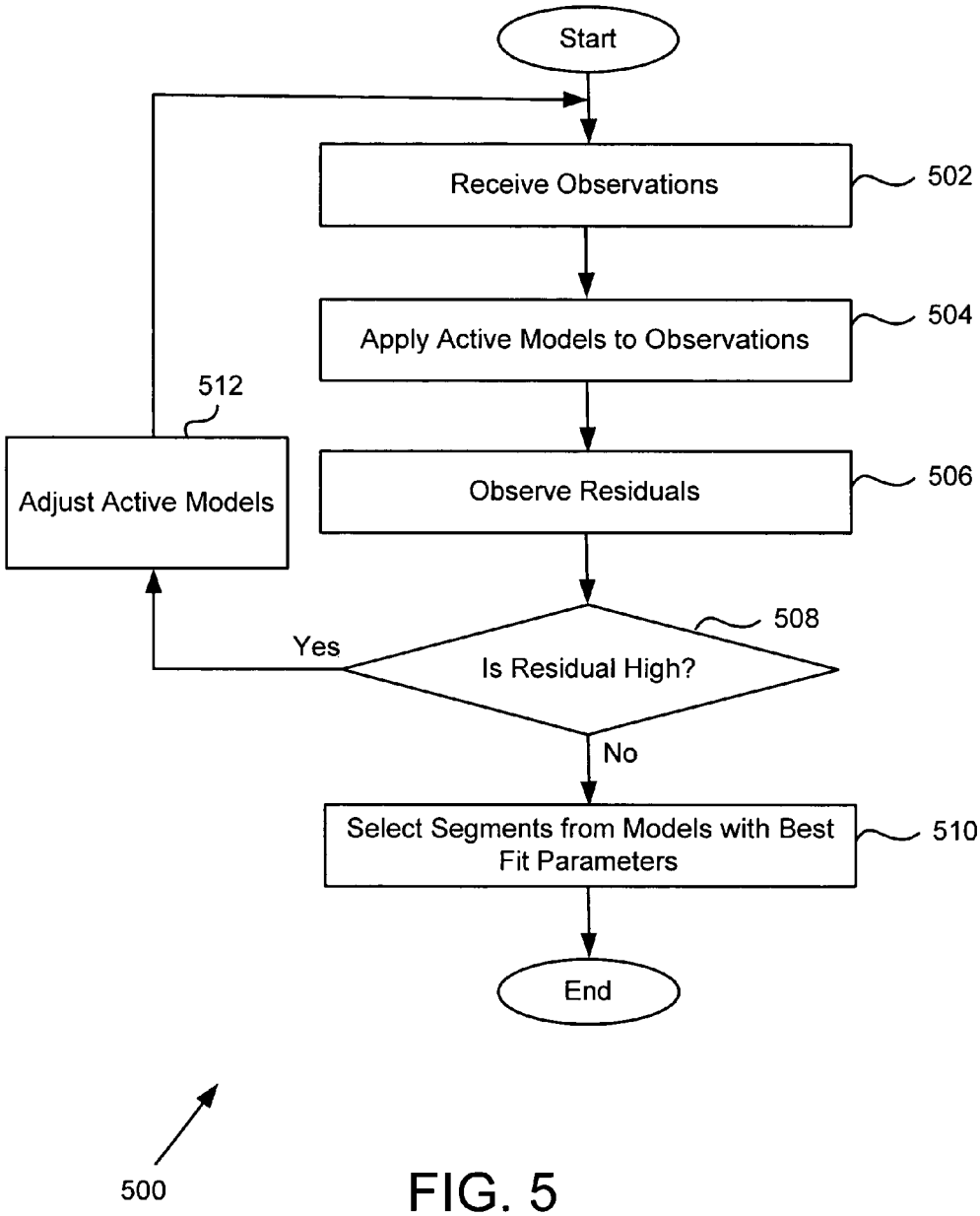
FIG. 5 is a flowchart of an exemplary method for model fitting.

Referring now to FIG. 5, a flowchart 500 of an exemplary method for model fitting is provided. In step 502, observations are received. In step 504, the observations and the source models are used to find a best fit of the models to the input observations. Fitting is achieved by standard gradient methods to reduce the costs between the observations and the model predictions. In step 506, the residual is found. The residual is observed signal energy not accounted for by the best fit model predictions. In step 508, the AMMO 110 (FIG. 1) uses the residual and the observations to determine if additional models should be made active or if any current models should be eliminated. In step 512, active models are adjusted. For example, if there is significant residual energy that could be accounted for by the addition of a tone model, a tone model is added to the model list. Also, additional information regarding the addition of a tone model is derived from the observations. For example, harmonics may be accounted for by a different tone model, but may also be accounted for better by a new tone model with a different fundamental frequency. In step 510, the best fit models are used to identify segments from the original input audio signal.

Figure 6:
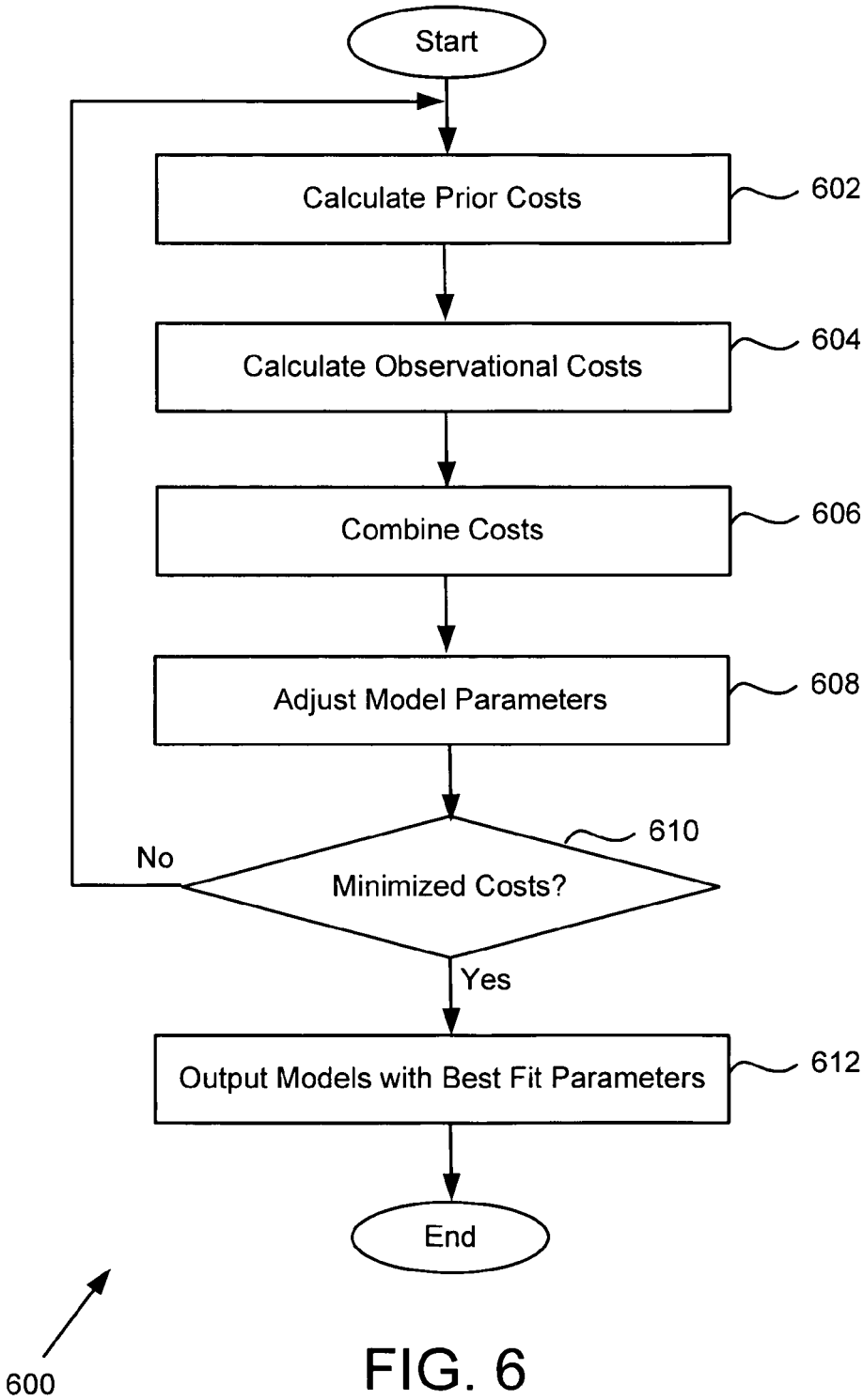
FIG. 6 is a flowchart of an exemplary method for determining a best fit.

Referring now to FIG. 6, a method for finding a best fit is shown. In step 602, prior costs are calculated using model and prior model information. In step 604, observational costs are calculated using model and observation information. In step 606, prior costs and observational costs are combined. In step 608, model parameters are adjusted to minimize the costs. In step 610, the costs are analyzed to determine if the costs are minimized. If the costs have not been minimized, prior costs are again calculated in step 602 with the new cost information. If the costs are minimized, then, the models with the best fit parameters are made available in step 612.

Embodiments of the present invention have been described above with reference to exemplary embodiments. It will be apparent to those skilled in the art that various modifications may be made and other embodiments can be used without departing from the broader scope of the invention. Therefore, these and other variations upon the exemplary embodiments are intended to be covered by the present invention.

What is claimed is:

1. A method for modification of an audio input signal by a digital communications device, the method comprising:

generating at least one observed segment model parameter based on the audio input signal and a configured segment model and storing the at least one observed segment model parameter within the digital communications device, the audio input signal including noise segments;

comparing the at least one observed segment model parameter stored within the digital communications device with at least one predicted segment model parameter stored within the digital communications device;

configuring a source model stored within the digital communications device based on the comparison; and generating at least one source model parameter based on the configured source model, the at least one source model parameter facilitating modification of an analyzed signal by the digital communications device.

2. The method of claim 1 further comprising determining if the source model comprises a best fit source model.

3. The method of claim 2 wherein the determining is based on a cost analysis.

4. The method of claim 1 wherein configuring the source model comprises creating the source model.

5. The method of claim 1 wherein configuring the source model comprises adjusting the source model if the source model is not a best fit source model.

6. The method of claim 1 further comprising comparing an observed feature segment with a predicted feature segment, wherein the configured segment model is based on the comparison.

7. The method of claim 6 further comprising generating the observed feature segments utilizing spectro-shape trackers.

8. The method of claim 1 further comprising generating the analyzed signal by converting the audio input signal into a frequency domain.

9. The method of claim 1 further comprising generating at least one control signal based on the at least one source model parameter, the at least one control signal controlling the modification of the analyzed signal.

10. A system for modification of an audio input signal, comprising:

an adaptive multiple-model optimizer configured to generate at least one source model parameter for facilitating modification of an analyzed signal, the adaptive multiple-model optimizer further comprising, a segment grouping engine configured to group simultaneous feature segments to generate at least one segment model and to generate at least one observed segment model parameter based on the audio input signal and a segment model, the audio input signal including noise segments; and a source grouping engine configured to generate at least one source model based on the at least one segment model, the at least one source model providing the at least one source model parameter.

11. The system of claim 10 further comprising a feature extractor configured to extract the feature segments utilized by the segment grouping engine.

12. The system of claim 11 wherein the feature extractor comprises a spectral peak tracker to track spectral peaks of the analyzed signal.

13. The system of claim 11 wherein the feature extractor comprises a tone tracker configured to determine feature segments associated with tones.

14. The system of claim 11 wherein the feature extractor comprises a transient tracker configured to determine feature segments associated with transients.

15. The system of claim 11 wherein the feature extractor comprises a noise tracker configured to determine feature segments associated with noise.

16. The system of claim 10 further comprising an analysis module configured to convert the audio input signal into the analyzed signal, the analyzed signal being in a frequency domain.

17. The system of claim 10 further comprising an attention selector configured to generate control signals for the modification of the analyzed signal based on at least one source model parameter obtained from the at least one segment model.

18. The system of claim 10 further comprising an adjuster configured to modify the analyzed signal based on at least one source model parameter obtained from the at least one segment model.

19. A non-transitory machine readable medium having embodied thereon a program, the program being executable by a machine to perform a method for modification of an audio input signal, the method comprising:

generating at least one observed segment model parameter based on the audio input signal and a configured segment model and storing the at least one observed segment model parameter within the digital communications device, the audio input signal including noise segments;

comparing the at least one observed segment model parameter with at least one predicted segment model parameter;

configuring a source model based on the comparison; and generating at least one source model parameter based on the configured source model, the at least one source model parameter facilitating modification of an analyzed signal.

* * * * *